United States Patent [19]

Shimizu

[11] 4,275,772

[45] Jun. 30, 1981

[54] HEDDLE FRAME

[75] Inventor: Yoichi Shimizu, Izumishi, Japan

[73] Assignee: Kabushiki Kaisha Maruyama Seisakusho, Sakai, Japan

[21] Appl. No.: 117,572

[22] Filed: Feb. 1, 1980

[30] Foreign Application Priority Data

Sep. 3, 1979 [JP] Japan ..... 54-120466[U]

[51] Int. Cl.[3] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 2,897,844 | 8/1959 | Graf | 139/91 |
| 3,335,759 | 8/1967 | Koch | 139/91 |
| 3,753,405 | 8/1973 | Koch | 139/91 |

FOREIGN PATENT DOCUMENTS

| | | | |
|---|---|---|---|
| 925562 | 5/1963 | United Kingdom | 139/91 |

*Primary Examiner*—Henry Jaudon

*Attorney, Agent, or Firm*—Oblon, Fisher, Spivak, McClelland & Maier

[57] ABSTRACT

A joint between a cross bar and a side-stay of a heddle frame is disclosed. The cross bar is hollow and has a joint block inserted in the end thereof. The joint block extends into the hollow side-stay and contacts a pressing piece and a pressure receiving piece on opposite sides thereof. The pressing piece has a V-shaped projection which mates with a V-shaped groove on one face of the joint block for mating contact therebetween. The pressing piece and joint block have aligned bolt holes which are in turn aligned with a threaded hole in the pressure receiving piece. A clamping bolt is insertable through the bolt holes and screwable into the threaded hole to secure the pressing piece, joint block and pressure receiving piece together for securing the joint of the heddle frame.

7 Claims, 10 Drawing Figures

HEDDLE FRAME

BACKGROUND OF THE INVENTION

1. Field of the Invention:

The invention relates to heddle frames with an improved structure for fixing the aluminum bar to the side tray.

2. Description of the Prior Art:

FIG. 1 is a partially abbreviated side elevation view of a heddle frame of a loom which has been conventionally used, wherein 1' indicates an aluminum bar, the end of which is fixed with side stay 2' to form a frame. In the drawing, 3' is a heddle rod which is horizontally suspended to side stay 2' and expandingly supports many heddles 4'. The heddle rod is supported by middle hooks 5' at a given interval in the length of the rod; the middle hook 5' is fixed by hook hanger 6' which is engaged in the supporting line groove 7' on aluminum bar 1'.

In the drawing, 8' is a guide plate which guides the function of aluminum bar 1'.

In the conventional heddle frame constituted by the above described structure, a fixing structure A and A', portions of which joint aluminum bar 1' and side stay 2', requires greater fixing strength as the speed of the loom becomes higher. An increase of the joint strength of aluminum bar 1' and side stay 2', however, leads not only to a complicated joint structure requiring very difficult assembly and disassembly, but also results in increased inertia force for the opening operation of the heddle frame because of increased weight, or in the failure of the joint of aluminum bar 1' or in deficiencies such as greater wear or higher noise. Therefore, a variety of devices have been considered for the fixing structure of A and A'. However, none with a satisfactory joint structure has been developed yet.

SUMMARY OF THE INVENTION

The present invention has as its object to supply a practical and convenient heddle frame characterized in joining an aluminum bar and a side stay by the use of a special joint-block. The present invention also includes pressing and pressure receiving pieces resulting in a simple structure which allows easy assembly and disassembly of the side stay against the aluminum bar with a relatively light-weight, highly rigid structure, thereby complying with the higher speed operation of the loom.

BRIEF DESCRIPTION OF THE DRAWINGS

Various other objects, features and attendant advantages of the present invention will be more fully appreciated as the same becomes better understood from the detailed description of the drawings wherein like reference characters designate like or corresponding parts throughout the several views, and wherein.

DETAILED DESCRIPTION OF THE PREFERRED EMBODIMENTS

Figure 1:
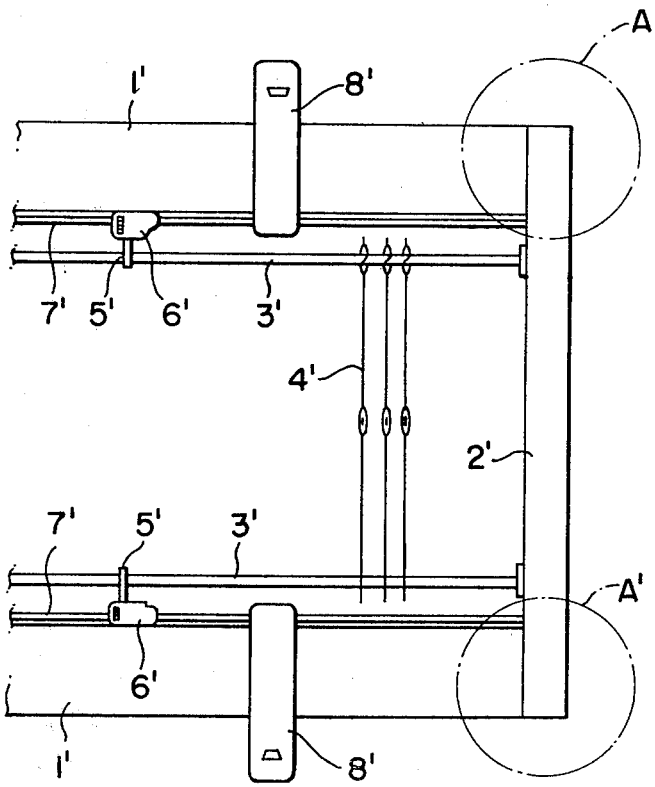
FIG. 1 is a side view of a conventional heddle frame of a loom, partially abbreviated.
Figure 2:
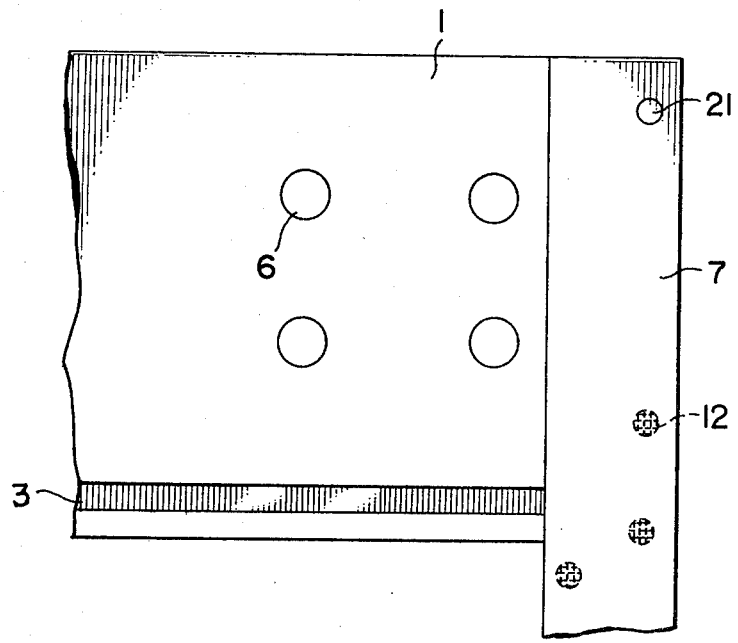
FIG. 2 is the side view of a part of the heddle frame of this invention corresponding to the A portion of FIG. 1.

In the Figures, 1 is an aluminum bar, in which a hollow portion 2 is formed. A guide groove line 3 is provided on the under side of the bar to engage in a hook hanger. Portion 4, like hollow 2, is a hollow space formed to further reduce the weight of the aluminum bar.

Joint block 5 is inserted into the hollow portion 2 at the end of aluminum bar 1, and firmly fixed to it by rivets 6. The end of the block 5 projects horizontally from the end of aluminum bar 1 by an amount which is determined as necessary.

Stay 7 is a hollow side-stay constructed of a hollow square pipe which is to be connected to the end of aluminum bar 1. It is provided with an opening 9 at the side of the stay facing the end of the aluminum bar 1, to which projecting end 8 of the joint block 5 is to be inserted. Piece 10 is a pressure receiving piece fitted in the hollow part 11 of the side-stay 7, and is inserted in a position so that its end touches an opposing surface of the projected end part 8 of the joint block 5, which is horizontally inserted into the opening 9 on the side face of the side-stay 7. The piece 10 is fixed to side-stay 7 by spot welding 12 or by rivets.

Piece 13 is a pressing piece, loosely fitted in the hollow part 11 of the side-stay 7, and able to move up and down in the hollow portion 11. The sole of piece 13 is constructed so as to touch the opposing side of the projected part 8 of the joint block 5. Vertical through bolt holes 14 and 15 are respectively provided in the pressing piece 13 and the projected end 8 of joint block 5. A threaded hole 16 is provided in pressure receiving piece 10 so as to be aligned with bolt holes 14 and 15.

Bolt 17 is a clamping bolt, which may be set through bolt holes 14 and 15 and screwed into the threaded hole 16 of pressure receiving piece 10 and fastened to securely hold the projected part 8 of the joint block 5 against the sole of pressing piece 13 and the end of pressure receiving piece 10.

Figure 4:
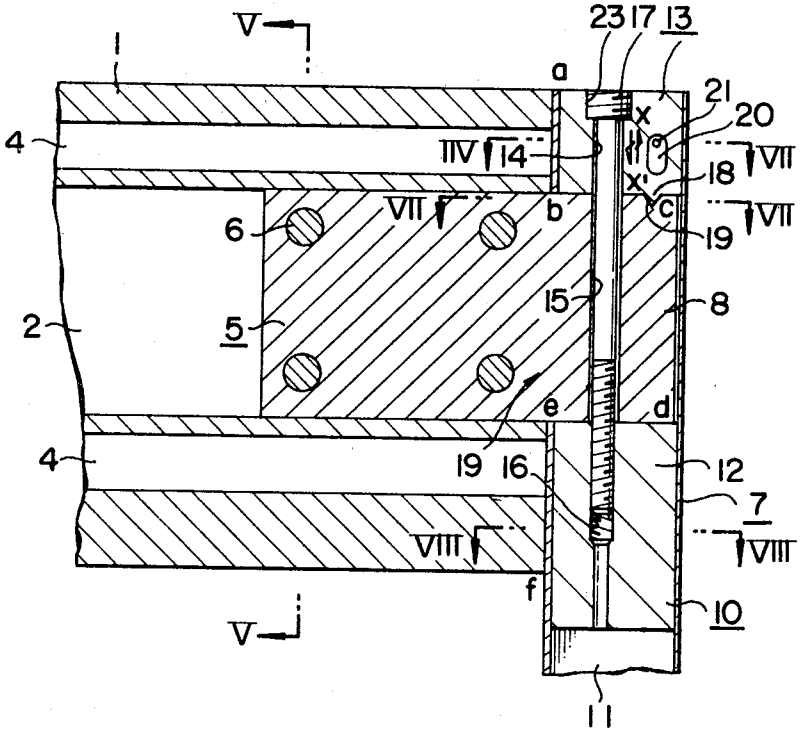
FIG. 4 is the sectional view of a cut along IV—IV line of FIG. 3.
Figure 6:
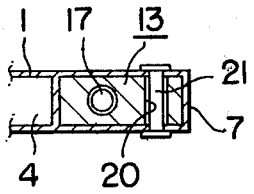
Figure 7:
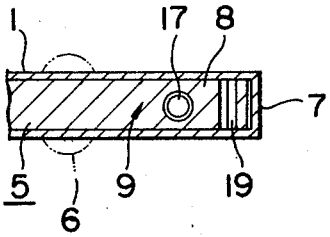

A V-shape projected line 18 is provided on the sole of the pressing piece 13 and is parallel with the edge of aluminum bar 1. On the other hand, as shown in FIG. 7, V-shape groove line 19 is constructed to join with V-shaped projected line 18 on the opposing face of the projected part 8 of the joint block 5. Vertically elongated guide hole 20 is provided on the side wall of pressing piece 13 as shown in FIG. 4 and FIG. 6, and pin 21, which is horizontally fixed to the side wall of side-stay 7, is loosely fitted in the guide hole 20.

Figure 3:
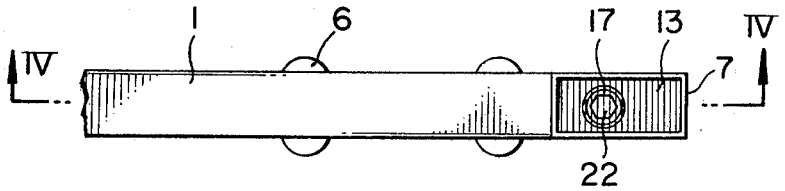
FIG. 3 is the plan of FIG. 2.
Figure 5:
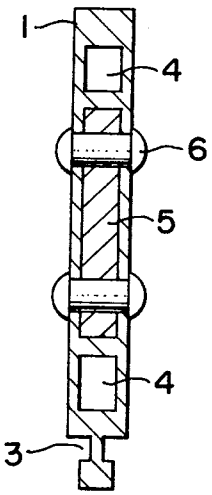
FIG. 5 through FIG. 8 are sectional views, respectively along the line V—V, line VI—VI, line VII—VII and line VIII—VIII of FIG. 4.

The head of the clamping bolt 17 is provided with hexagonal hole 22 as shown in FIG. 3, to allow access to the head immersed in the counter bored hole 23 provided on the end face of pressing piece 13.

To assemble the heddle frame of this invention, one may insert projected end 8 of the joint block 5 into the opening 9 of the side-stay 7, until the side of opening 9 of the side-stay 7 contacts with the end face of the aluminum bar 1. When pressing piece 13 receives an upward component force at the V-shape projected line at its base due to the opposing surface of projected end 8 as a result of the insertion of projected portion 8 of the joint block 5, the pressing piece 13, which is loosely fitted in the hollow part 11 of the end of side stay 7, can move in the X direction as shown in FIG. 4 because of the freedom of pin 21 to move up and down along the longitudinal length of guide hole 20. When the projected end part 8 is inserted fully into the opening 9 to make the side face of the side-stay contact with the end of aluminum bar 1, the V-shape projected line 18 of the pressing piece 13 meets with the V-shape groove line 19 of the projected part 8 of joint block 5 and the pressing piece 13 moves in the X' direction to make the V-shape projection 18 fit with V-shape groove line 19. And when the V-shape projected line 18 engages with the V-shape groove line 19 as shown in FIG. 4, the relative position of the parts is so determined that bolt hole 14 in pressing piece 13, bolt hole 15 in the projected portion 8 of the joint block 5 and the threaded hole 16 in the pressure receiving piece 10 will be aligned in the vertical direction. Therefore, clamping bolt 17 can be smoothly inserted through bolt holes 14 and 15, and by screwing the pointed end of the bolt in the threaded hole 16 to fasten tightly, the projected portion 8 of the joint block 5 is held between pressing piece 13 and pressure receiving piece 10, to strongly fix side-stay 7 to the end of aluminum bar 1 as shown in FIG. 4. In this case, the head of the bolt 17 is immersed in the counter sunk hole 23 to the surface of pressing piece 13. However, because of the hexagonal drive hole 22 of the head of the bolt 17, the screwing operation will not be obstructed even when the head of the clamping bolt is completely immersed in the counter sunk hole to the extent that the top face of the clamping bolt 17 comes even with the end face of the pressing piece 13.

To remove side-stay 7 from the end of the aluminum bar 1 for repair, maintenance and inspection purposes, it is required only to horizontally pull out side-stay 7 after loosening and removing clamping bolt 17. The aluminum bar 1 and the side-stay 7 will then be separated from the boundary line a-b-c-d-e-f shown in FIG. 4. It is clear that the horizontal pulling out of side-stay 7 causes the V-shape projection line 18, which is engaging in V-shape groove line 19, to be subjected to an upward component force which pushes the pressing piece 13 in the X direction to disengage the connection of V-shape projection line 18 and V-shape groove line 19, and that the projecting part 8 of joint block 5 will be smoothly pulled out of the opening 9 of the side-stay 7.

The structure shown in FIG. 2 through FIG. 8 is the portion corresponding to the portion A of FIG. 1. The portion A' is identically structured.

When side-stay 7 is removed from the end of the aluminum bar 1, the pressing piece 13, which is loosely fitted in the hollow portion 11 of the end of the side-stay 7, is loosely engaged to the guide hole 20 by pin 21. Therefore, it will not fall out of the hollow part 11 of the side-stay 7.

Because joint block 5 is firmly fixed to aluminum bar 1 with rivets 6, and the pressure receiving piece 10 is fixed firmly to the side-stay 7 by spot welding 12 or a rivet or rivets, their rigidity is quite high and they will not be loosened by repetetive attaching and removing.

Although, in the described example, pressing piece 13 was loosely fitted to side-stay 7 and allowed to move up and down, the device is intended to allow smooth attachment and removal of joint block 5 to or from side-stay 7, and the pressing piece 13 may be fixed if such consideration is unnecessary. It is evident that V-shape groove line 19, guide hole 20 and pin 21 can be eliminated, if such fixed attachment is applied.

Figure 9:
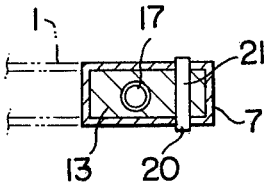
FIG. 9 is a sectional view indicating another embodiment corresponding to FIG. 6.
Figure 10:
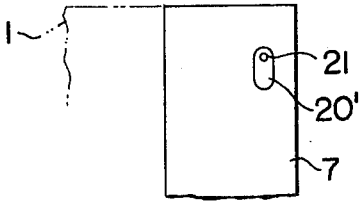
FIG. 10 is the side view of FIG. 9.
Figure 8:
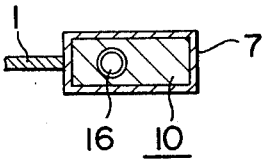

FIG. 9 and FIG. 10 are another embodiment of a device to fix a pressing piece to a side-stay, of which FIG. 9 is a sectional view corresponding to FIG. 6, and FIG. 10 is its side view. As may be clearly seen from the drawing, the apparatus of the present invention may be modified to provide an elongated guide hole 20 on the side wall of the side-stay 7 instead of the side wall of the pressing piece 13, and to allow pin 21, which is horizontally fixed to the pressing piece 13, to fit loosely in the guide hole 20' provided in the side-stay 7. This arrangement permits up and down movement of pressing piece 13, which is loosely fit in the hollow portion 11 of the end of the side-stay 7, and prevents the pressing piece 13 from falling out from the hollow portion 11.

Because this invention has the above structure and function, and because the joint block and pressure receiving piece are respectively inserted into aluminum bar and side-stay and are strongly fixed, this structure does not result in loosening by repetetive attachment and removal of the side-stay and is sufficiently durable for long service. The attachment or removal of the side-stay is made only by pushing or pulling the side-stay to or from the aluminum bar, with only the screwing in or loosening out of the clamping bolt, thereby resulting in very simple operation which may be completed in a short time.

Because the projected part of the joint block is inserted not only into the opening portion of the side-stay but is also held between the passing piece and pressure receiving piece and clamped to form one body with those pieces by way of clamping bolt, the joining strength between the aluminum bar and the side-stay is quite strong and its rigidity is high. The heddle frame can be made light in weight and low in cost because the aluminum bar and side-stay have a hollow portion, and the joint block, pressure receiving piece and pressing piece can be made of smaller pieces which can be inserted or loosely inserted into the hollow portions. Further, the aluminum bar and side-stay can be made to relatively higher moduli of elasticity due to their hollow sectional configuration, resulting in strong bending resistance, which is sufficient to bear high speed operation and heavy loads. Aside from those many advantageous points, the structure provides a very convenient heddle frame for practical applications, allowing one to locate their relative position automatically, so that they may be assembled only by engaging extruded portions of the pressing piece and joint block at the V-shaped projected line and the V-shaped groove line; the joint of the longitudinally elongated guide hole and a pin between the pressing piece and side-stay can prevent the falling of pressing piece which has vertical movement allowance. Further facilitating the clamping operation is the adoption of a hexagonal hollow head bolt for clamping.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. In a heddle frame including at least one aluminum bar and at least one hollow side-stay, a joint between said at least one bar and said at least one side stay, said joint comprising:

a joint block inserted in a hollow portion of said at least one bar and partially extending from said bar in the direction of the length of said bar;

an opening in said at least one side-stay, said opening adapted to have a portion of said joint block inserted therein;

a pressure receiving piece fixed in said at least one side-stay and adjacent one side of said opening wherein one face of said joint block may contact said pressure receiving piece;

a pressing piece in said at least one stay and adjacent another side of said opening wherein another face of said joint block may contact said pressing piece;

bolt holes in said pressing piece and said joint block and a threaded hole in said pressure receiving piece, said holes being positioned so as to be axially aligned when said joint block is fully inserted in said opening of said side stay; and a clamping bolt insertable through said bolt holes and screwable in said threaded hole to secure said pressing piece, joint block and pressure receiving piece together.

2. The apparatus of claim 1, wherein said aluminum bar and joint block are fastened with rivets, and pressure receiving piece and said side stay are fastened with one of rivets and welding.

3. The apparatus of claim 1 or 2 wherein said pressing piece is loosely fitted in said side-stay and adapted to be movable in the direction of the length of said side-stay.

4. The apparatus of claim 2 including a V-shaped projecting line on the contacting face of said pressing piece, said projecting line extending in a direction transverse to the length of said aluminum bar, and a V-shaped groove on said one face of said joint block, said groove adapted to mate with said projection.

5. The apparatus of claim 4 wherein said pressing piece includes an elongated guide hole extending in the direction of the length of said side-stay, and wherein a pin is fixed to a wall of said side-stay, said pin extending loosely into said guide hole.

6. The apparatus of claim 4 wherein said side-stay includes an elongated guide hole extending in the direction of the length thereof, and wherein a pin is fixed to said pressing piece, said pin extending loosely into said guide hole.

7. The apparatus of claim 5 wherein said bolt hole in said pressing piece is counter sunk on the face opposite said contacting face and wherein the head of said clamping bolt may be completely contained within said counter sunk portion and said head includes a hexagonal socket for driving said bolt.

* * * * *